United States Patent [19]

Risucci

[11] Patent Number: 4,817,803

[45] Date of Patent: Apr. 4, 1989

[54] LEAK RESISTANT MULTIPLE-COMPARTMENT FROZEN FOOD PACKAGE

[76] Inventor: Edward J. Risucci, 35-20 Leverich St., Jackson Heights, N.Y. 11372

[21] Appl. No.: 152,439

[22] Filed: Feb. 5, 1988

[51] Int. Cl.[4] ..... B65D 5/54

[52] U.S. Cl. ..... 206/602; 229/120.12; 229/DIG. 4; 229/905; 426/119; 426/122

[58] Field of Search ..... 206/602, 602.1, 627; 229/120.12, 120.15, 120.16, 120.17, 120.18, 120.35, 6 R, 16 R, DIG. 4, 905, 23 R; 426/115, 119, 122; 220/62

[56] References Cited

U.S. PATENT DOCUMENTS

| | | | |
|---|---|---|---|
| 1,876,063 | 9/1932 | Kronenberger | 229/DIG. 4 |
| 2,205,437 | 6/1940 | Ringler | 206/602 |
| 2,486,563 | 11/1949 | Jorgenson | 220/62 |
| 2,896,837 | 7/1959 | Risucci | 206/602 |
| 4,694,954 | 9/1987 | Moss | 229/DIG. 4 |

FOREIGN PATENT DOCUMENTS

| | | | |
|---|---|---|---|
| 2584049 | 1/1987 | France | 206/602 |
| 997081 | 6/1965 | United Kingdom | 229/23 R |

*Primary Examiner*—Stephen Marcus
*Assistant Examiner*—Gary E. Elkins
*Attorney, Agent, or Firm*—Ostrolenk, Faber, Gerb & Soffen

[57] ABSTRACT

A blank for being folded into a food container has one group of fold lines along which the blank is folded to form an elongate, tubular, rectangularly shaped food container. The blank is provided with a second set of closely spaced fold lines which extend transversely to the length of the tubular food container. There is a third fold line between each pair of second fold lines. The second and third sets of fold lines are formed so that pressing the food container from opposite longitudinal ends causes sections of the blank disposed between the second fold lines to fold inwardly at the third fold lines, to define and form a plurality of food compartments in the food container. A set of slits is formed in the blank at the locations of the corners of the compartment forming indentations. The slits permit the indented walls to pass through one another in an overlapping manner and in a manner which seals the corners against leakage of food.

19 Claims, 2 Drawing Sheets

FIG. 2.
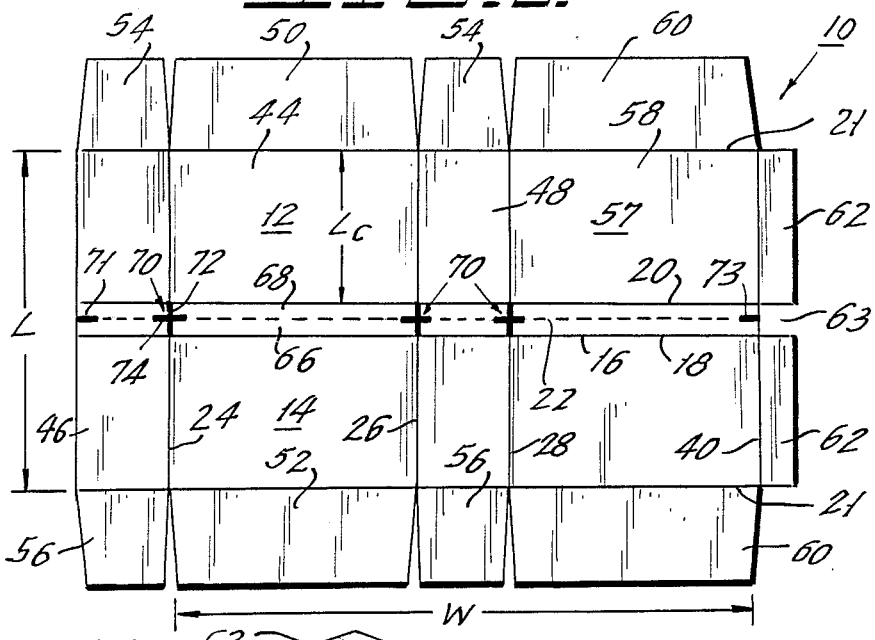
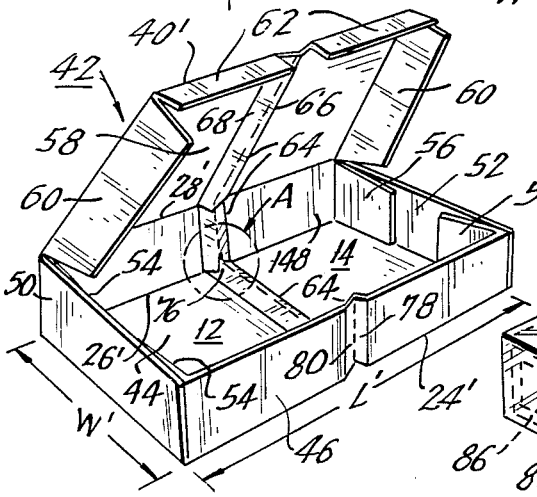
FIG. 3.
FIG. 4.
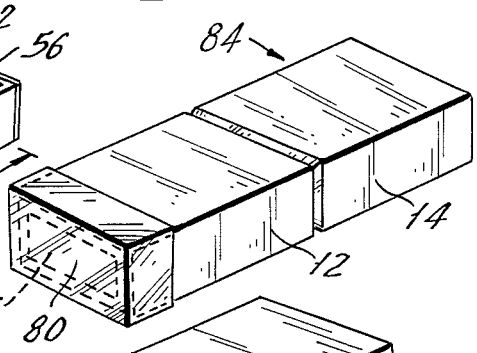
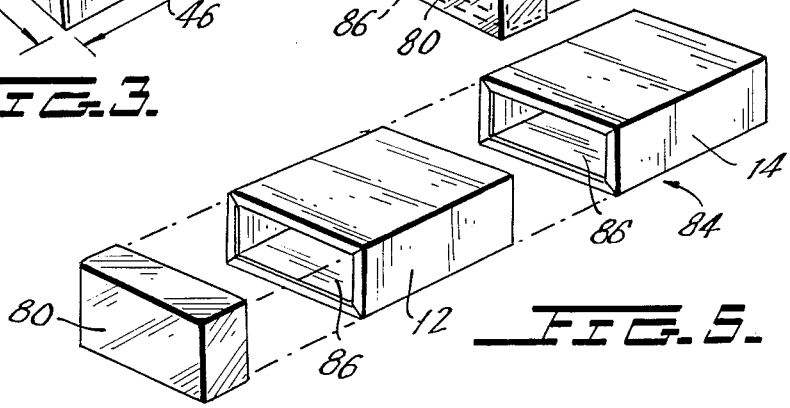
FIG. 5.

LEAK RESISTANT MULTIPLE-COMPARTMENT FROZEN FOOD PACKAGE

BACKGROUND OF THE INVENTION

This invention relates to a compartmented food container for frozen foods and, more particularly, to a leak proof food container which is formed from a single folded blank sheet and provides several food compartments which are easily separable from one another.

The present invention improves on the present inventor's prior invention, described in U.S. Pat. No. 2,896,837 (the "'837 Patent"), the contents of which are incorporated by reference herein. The '837 Patent describes a generally rectangular blank or sheet, which can be shaped into an elongate tubular container for frozen food, by being folded along a set of fold lines which are stamped or scored into it. The container is filled with food through one of its distal ends, which end has a closable end cap.

The blank of the '837 Patent is scored with at least one additional set of fold lines which extend transversely to the length of the container. The additional fold lines are placed such that pressing upon the container from opposite longitudinal directions causes those portions of the wall of the container, which are situated between the fold lines, to be indented dented inwardly into the interior of the container. The indentations are deep enough to, in effect, compartmentalize the food in the container. There is one continuous block of food extending between the longitudinal ends of the container. But the block has separation planes defined by the indentations. Consequently, a food compartment between separation planes can be severed from the remainder of the container relatively easily and in a manner which does not disturb the food in the remaining compartments.

This known container blank also includes an integral, protruding, section at one end which is eventually shaped into an end cap. The end cap is hingedly attached to the container to seal the initially open distal end through which food is introduced into the container. Subsequently, and after the first food section has been severed, the end cap is torn away from the first food compartment and may be reused to seal the exposed end of the remainder of the container.

The above-described blank/food container has several shortcomings. For example, to enable the peripheral wall of the container to bend inwardly at the corners of the rectangular container, where two side panels meet, to form the compartment-defining indentations, the blank is provided with diamond shaped cut-outs at the corners. The cut-outs were meant to self seal, once the container had been longitudinally compressed. It has now been determined, however, that, in practice, the container is still susceptible to leaking through these cut-outs.

This leakage problem is illustrated in FIG. 1 herein. The cut-outs 30 allow the panels 32 and 34 to bend neatly at the corners, as compartments 36 and 38 are pressed together. While perfect abutment of panels 32 and 34 should seal the corners, in practice, due to filling problems, the incomplete abutment of the panels 32, 34 and due to manufacturing inaccuracies such as imperfect shaping of the cut-outs 30, the corners remain imperfectly sealed.

As a result, food is certain to leak through the cut-outs at the corners, during container filling, after filling but prior to solidifying or even under minor thawing conditions. This defeats a primary objective of the '837 Patent to provide a hygienic and leak proof food package.

Another disadvantage of the known food container is that it has an elongate tubular shape and is fillable with food only from its distal end. Filling a food container from its distal end is more difficult and inefficient. It provides less control over the placement and arrangement of food in the container.

Furthermore, the integrally formed and hingedly movable end cap of the '837 Patent has been found to provide incomplete closing and sealing for the distal end of the container. The reason is that the end cap has to be somewhat loose to enable it to swing over and enclose the distal end. The problem is aggravated after the end cap is severed from its original position at the end of the container and is reused to cover the exposed end of remaining sections of the container from which one or more food compartments have been severed.

SUMMARY OF THE INVENTION

It is an object of the present invention to provide a container blank and a food container fashioned therefrom which avoid the above shortcomings of the prior art.

It is another object of the present invention to provide a leak proof food container.

It is another object of the present invention to provide a food container having a plurality of leak proof and severable compartments.

It is yet another object of the present invention to provide an easily fillable food container.

It is another object of the present invention to provide an improved end cap for sealing the exposed side of a multi-compartment food container from which one or more food compartments were severed.

The foregoing and other objects of the invention are realized by a food container, preferably for frozen food, fashioned from a generally rectangular, planar, blank or sheet. The blank is stamped or scored with fold lines along which the blank is easily folded to form the food container. Additional fold lines formed in the blank enable the formation of a plurality of transversely extending and longitudinally spaced indentations in the body of the container. These indentations define a plurality of food compartments along the length of the completed container. The bases or deepest points of the indentations are more heavily scored to enable any of the compartments of the container and the food contained therein to be easily broken off, e.g. by a bending force, or cut away from the remaining food compartments, while the food contents remain frozen.

More specifically, the blank of the present invention is scored with three groups of fold lines. A first group includes a plurality of pairs of moderately scored fold lines. The two lines of each pair are closely spaced. Each of these first fold lines extends transversely to the length of the blank. The first line pairs are spaced from one another along the length of the container and establish the lengths of the compartments. The short length sections of the blank between each pair of the first fold lines become the indentations between adjacent food compartments. The depth of the indentations is determined by the spacing between the lines in each pair.

A second group of more heavily scored, or even intermittently perforated, fold lines define the lines or, more correctly, the planes along which the food compartments can be severed from one another. Each second line extends transversely to the blank and centrally through the space between a pair of the first fold lines. Each second fold line defines and lies at the bottoms of an indentation.

A third group of fold lines extend lengthwise along the blank, perpendicularly to the first and second groups of fold lines. The third fold lines define lengthwise-extending corners of the food container between its adjacent panels.

In place of the leak prone diamond-shaped cut-outs of the '837 Patent, the present invention provides, at the intersection of the second and third fold lines, a pair of perpendicular slits. The first slit of each pair lies on one of the third fold lines and extends between a pair of the first fold lines. The second slit is perpendicular to the first slit and lies on one of the second fold lines. The slits are straight. They may be, however, slightly tapered toward their intersection point to provide larger slit openings to accommodate the thickness of the portion of the blank which forms the indentation.

The relative lengths of the slits in each pair may vary, e.g. in accordance with any of five different embodiments described further herein. All slit embodiments are, however, effective to enable the food container to be compressed in a manner similar to that of the '837 Patent to form the indentations. However, the substitution, in the present invention, of the slits for the diamond shaped cut-outs produces considerable overlapping between inwardly indented panels of the blank at the corners of the food container, which results in practically perfect sealing of the containers.

The blank of the present invention further includes end flaps on all sides which cooperate with the main body of the blank so that it can be folded into a food container which is accessible through the top and has a large closable upper lid which extends over all of the food compartments. Consequently, the food can be arranged in the compartments of the container in any desired order. Either before or after it is filled with food, or the like, that will be frozen, the container is pressed inwardly from its opposite longitudinal ends, to bend in the third fold lines to form the inwardly directed indentations which define the compartments, as was done in the prior art.

The present invention further provides a separate end cap for covering that end of the container which becomes exposed after one or more of the compartments are removed. In contrast to the prior art, the end cap is tightly dimensioned to the peripheral shape of the container to provide more effective sealing between them. The end cap may be formed of the material of which the blank is formed or of another, less stretchable, material, e.g. plastic.

Other features and advantages of the present invention will become apparent from the following description of the invention which refers to the accompanying drawings.

BRIEF DESCRIPTION OF THE DRAWINGS

FIG. 2 is a plan view of a blank for forming a food container, in accordance with the teaching of the invention.

FIG. 3 is a perspective view of a food container formed from the blank of FIG. 2.

FIG. 4 is a perspective view an alternate embodiment of a food container formed of a blank of the type illustrated in FIG. 2.

FIG. 5 is an exploded perspective view of several severed sections of the food container of either FIGS. 3 or 4, including an end cap.

Figure 1:
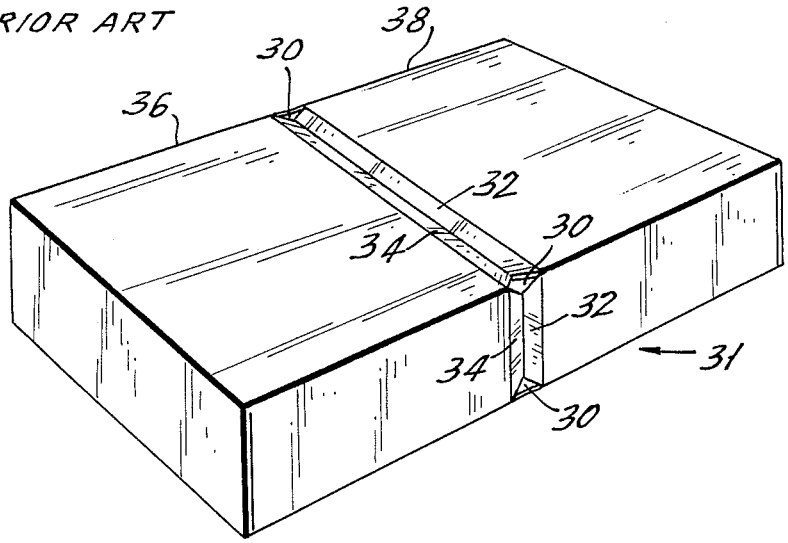
FIG. 1 PRIOR ART
FIG. 1 is a perspective of a food container formed in accordance with U.S. Pat. No. 2,896,837.

FIGS. *7a–7e* depict various slit embodiments.

DETAILED DESCRIPTION OF PREFERRED EMBODIMENTS

FIG. 2 illustrates a planar, generally rectangular, blank 10 designed for being folded into a food container, for example, the container 42 of FIG. 3. The blank 10 may be fabricated of any convenient material suitable for containing food and capable of permitting such food to be frozen or otherwise treated such as treated paper, cardboard, even plastic. Blank 10 has a length dimension "L", which is aligned to the dimension "L'" of container 42, a plurality of food compartments 12, 14 being defined along the length "L". For a given compartment size, the length "L" is adjusted to obtain a desired number of such food compartments. While blank 10 of FIG. 2 is designed to provide only two compartments 12 and 14 (see also FIG. 3), three, four or any number of compartments may be provided by making blank 10 sufficiently long or by subdividing it into shorter compartments.

Three groups of intersecting, scored in, fold lines and a set of slits cut into blank 10 enable the blank to be shaped into the multi-compartment container 42 with relative ease.

Blank 10 has a first group of moderately scored fold lines comprised of pairs 16 of closely spaced fold lines 18 and 20. While FIG. 2 shows only a single pair 16 of the first fold lines (for defining the boundary between the compartments 12 and 14), a plurality of such pairs 16 are provided to define additional compartments. Each pair 16 of first fold lines extends across the width "W" of blank 10. The spacing between adjacent pairs 16 and the spacing between the last pair at each longitudinal edge and a end fold 21 at the cover flap (not applicable in the embodiment of FIGS. 2 and 3) defines the desired length "$L_c$" of any of food compartments 12, 14, etc. The lengths "$L_c$" of the food compartments may, but need not, be equal to one another.

A second group of fold lines 22 extend across the width of blank 10, in the direction of and located centrally between the first fold lines 18 and 20. The second fold lines 22 are weakened by being more heavily scored and may even be formed of a series of slits through the blank. They define the tear or break demarcation lines between compartments. FIG. 2 shows a single weakened line 22, but a plurality of such lines can be provided to define more than two food compartments.

The first and second groups of lines enable formation of transverse indentations 64 (FIG. 3) which define the boundaries between adjacent compartments, such as compartments 12 and 14.

A third group of fold lines extends along the length of the blank and includes lines 24, 26, 28 and 40 which are spaced from one another along the width "W" of blank 10. These third fold lines define the lengthwise-extending corners 24', 26', 28', and 40' of container 42, as seen in FIG. 3.

The "+" or cross shapes in FIG. 1 depict pairs of perpendicularly oriented slits 70 which are cut into the blank 10, at the intersection of the second lines 22 with the third lines 24, 26 etc., for a purpose to be described. There are also slits 71 and 73, respectively, at the left and right side edges of blank 10 for a purpose to be described.

Various flaps extend from the main body 57 of blank 10 to form panels and walls in container 42. Identical reference numerals were assigned so that the panels and walls of FIG. 3 may be correlated to the flaps of FIG. 2.

As seen in FIG. 3, container 42 has a base 44 defining the bottoms of food compartments 12 and 14, a front wall 46, a rear wall 48, a left wall 50 and a right wall 52. Two left flaps 54 join the left wall 0 to front and rear walls 46 and 48, with the aid of an adhesive, a staple or any attaching means. Two right flaps 56 perform the same function for right side wall 52. The remaining section of main body 57 of blank 10 forms a hingedly connected upper cover 58 for container 42 and includes side closure flaps 60 and front closure flaps 62. If desired, flaps 62 may be formed without the notch 63, in which case slit 73 would have the shape of one of the slits 70.

Container 42 is divided, along its length "L'", into the aforementioned compartments 12 and 14, by the transversely extending indentation 64. The indentation 64 projects into the interior of container 42 from the entire transverse perimeter of the container. Each indentation 64 is formed by indent panels 66 and 68 (see also FIG. 6). Panels 66 and 68 are defined between indentation 64, on the one hand, and fold lines 18 and 20, respectively, on the other hand. Panels 66 and 68 abut one another in response to the container 42 being pressed from opposite ends, by any means, e.g. by hand, rubber band or any clamping means.

The slits 70, at the corners 76 of container 42, enable the indented panels 66 and 68 to fit at the corners in a non-interfering manner. These slits 70 may be formed according to any one of the slit embodiments of FIGS. *7a–7e*. Each pair of slits 70 includes, according to the embodiment of FIG. 2 and FIG. *7a*, a first slit 72 formed on the longitudinally extending fold lines (24, or 26, or 28) and extending between fold lines 18 and 20 and a perpendicularly oriented, second slit 74 of the length of slit 72. Slits 72 and 74 may be slightly tapered or thickened toward their intersection, as denoted by the dotted lines in FIG. *7a*, sufficient to provide only a tight space for the folded indented panels 66 and 68 to fit therein.

The shape of the slits 70 is not limited to the "+" shaped slits 70 of FIG. *7a*. Any one of the "T" shaped slits 70 of FIGS. *7b–7e* may be used just as effectively. For example, in FIG. 6 there is no slit at location 71, the slit configuration corresponding to the embodiment of FIG. *7d*.

Figure 6:
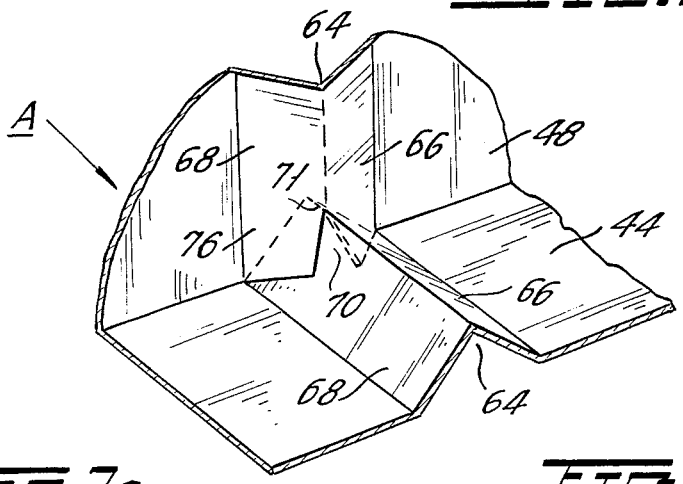
FIG. 6 is an enlargement of section A in FIG. 3.
Figure 7A:
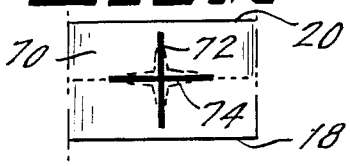
Figure 7D:
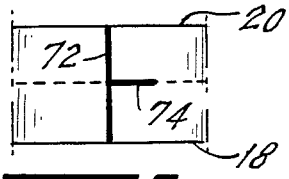
Figure 7B:
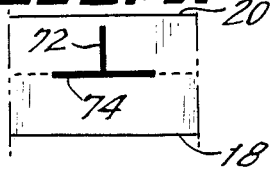
Figure 7C:
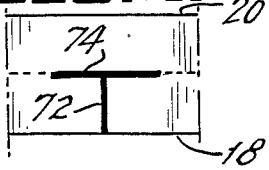
Figure 7E:
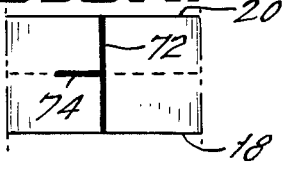

In any case, and as seen in FIG. 6, slits 70 permit indented panels 66, 68 to pass through one another in a non-interfering manner. Moreover, container 42 is easily compressed such that panels 66 and 68 abut one another along the entire perimeter of container 42, including the corners 76. In fact, at the corners 76, the indented and tightly overlapped panels 66 and 68 (FIG. 6) form seals which prevent flowable substances, even liquids, from penetrating between the overlapped panels 66 and 68, providing a hygienic and leak proof food container.

In use, container 42 is filled from the top with food, the food being arranged, as desired, in the compartments 12, 14 etc. Of course, the container could be filled from the end too. After the container is filled from the top, the upper cover 58 is then closed over the food, and the flaps 60 and 62 are folded over the sides and front walls of the container. Before or after being filled, container 42 is pressed from opposite sides to form the indentations 64 which create potential break lines in the frozen food in the container.

To obtain a portion of food, one (or more) of the compartments 12, 14 etc. is severed or cut off from the remaining compartments, along the heavily scored line 22 which lies deep in the indentation 64. The deeper or further that the indentations 64 project into the interior of container 42, the easier it is to sever the compartments from one another. The depth of the indentation is determined by the spacing between the lines 18, 20, and that spacing may be tailored to suit the type of food intended to be stored in a given style of container.

Once a portion of a container 42 is severed, a generally rectangular, end cap 80, of the type depicted in FIGS. 4 and 5, is deployed to cover the exposed side of container 42. End cap 80 may be formed of the same material as the blank 10 is formed or it may be formed of a different material, for example, plastic.

The separately provided end cap 80 of the present invention is not limited by the design constraints of the hingedly mounted and integrally formed end cap of the '837 Patent. Consequently, end cap 80 is sized to provide a tighter fitting cap over the exposed side 86 of the container 84 (FIG. 4) to improve sealing.

FIG. 4 depicts a container 84 modeled after the container depicted in FIG. 5 of the '837 Patent. However, container 84 of the present invention has a non-integral end cap 80 for enclosing the distal end thereof and is formed of a blank 10 having the slits 70, rather than the diamond-shaped cut-outs 30.

FIG. 5 illustrates the container 84 of FIG. 4 in a state where the compartments 12 and 14 have been severed from one another.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A blank for forming a food container having separable food compartments, the blank comprising:

a blank sheet having length and width dimensions;

first fold lines comprising at least one pair of relatively closely spaced fold lines scored into the blank, the first fold lines extending transversely to the length of the blank;

a respective second fold line extending in the direction of and located between each pair of the first fold lines;

a plurality of third fold lines extending along the length of the blank and intersecting the first and second fold lines; and a plurality of pairs of slits extending through the blank, each pair of slits being located at an intersection point of the second and third fold lines and the slits of each pair intersecting.

2. A blank as in claim 1, in which each pair of slits includes a first slit and a second slit crossing perpendicularly through one another.

3. A blank as in claim 1, in which each pair of slits includes a first and a second slit, the slits of each pair being oriented in a T configuration relative to one another.

4. A blank as in claim 2, in which the slits are thickened and slightly tapered toward their intersection.

5. A blank as in claim 3, in which the slits are thickened and slightly tapered toward their intersection.

6. A blank as in claim 1, in which the blank is foldable along the third fold lines into a hollow tubular body and wherein sections of the blank lying between each pair of the second fold lines are indentable into the hollow body to define a plurality of food compartments.

7. A blank as in claim 6, in which each of the indented sections comprises first and second indented panels, the hollow body having a plurality of corners and the indented panels passing through and overlapping one another in the corners to provide seals for the corners of the container.

8. A blank as in claim 3, in which the blank is foldable along the third fold lines into a rectangular container.

9. A blank as in claim 8, wherein the container has a pivotally movable upper cover, pivotable on one of the third fold lines.

10. A blank as in claim 9, in which the upper cover extends over a side of the container which provides simultaneous access to all the food compartments.

11. A blank as in claim 1, in which the blank comprises end flaps for forming front and side walls of a food container.

12. A blank as in claim 8, further including a rectangularly shaped end cap which fits over and encloses an exposed end of the container.

13. A blank as in claim 12, wherein the end cap is fabricated of plastic.

14. A blank as in claim 1, in which the second fold lines are constituted of a series of slits in the blank.

15. A container for frozen food, comprising:

an elongate tubular interior defined by an elongate, peripherally extending wall, the wall being scored with a set of spaced folded lines for separating the container into a plurality of food compartments;

a blank having a length dimension for forming the wall of the container;

first fold lines comprising at least one pair of relatively closely spaced fold lines scored into the blank, the first fold lines extending transversely to the length of the blank;

a respective second fold line extending in the direction of and located between each pair of the first fold lines;

a plurality of third fold lines extending along the length of the blank and intersecting the first and second fold lines; and a plurality of pairs of slits extending through the blank, each pair of slits being located at an intersection point of the second and third fold lines and the slits of each pair intersecting.

16. A container as in claim 15, in which each pair of slits includes a first slit and a second slit crossing perpendicularly through one another.

17. A container as in claim 15, in which each pair of slits includes first and second slits, the slits being oriented in a T configuration relative to one another.

18. A container as in claim 17, further comprising a rectangularly shaped end cap which fits over and encloses an exposed end of the container.

19. A container as in claim 17, in which the wall of the container includes a pivotally movable upper cover which extends over a side of the container which provides simultaneous access to all the food compartments.

* * * * *